US006837596B2

(12) United States Patent
Tanaka et al.

(10) Patent No.: US 6,837,596 B2
(45) Date of Patent: Jan. 4, 2005

(54) LIGHTING DEVICE

(75) Inventors: Tsunemichi Tanaka, Tokyo (JP); Tsutomu Ishizone, Tokyo (JP); Masaki Asaoku, Tokyo (JP); Keijiro Asakura, Tokyo (JP)

(73) Assignee: Marumo Electric Co., Ltd., Tokyo (JP)

( * ) Notice: Subject to any disclaimer, the term of this patent is extended or adjusted under 35 U.S.C. 154(b) by 0 days.

(21) Appl. No.: 10/258,989

(22) PCT Filed: Jun. 20, 2001

(86) PCT No.: PCT/JP01/05248

§ 371 (c)(1),
(2), (4) Date: Oct. 31, 2002

(87) PCT Pub. No.: WO01/98707

PCT Pub. Date: Dec. 27, 2001

(65) Prior Publication Data

US 2003/0076682 A1 Apr. 24, 2003

(30) Foreign Application Priority Data

Jun. 20, 2000 (JP) ..... 2000-185102
Jun. 20, 2000 (JP) ..... 2000-185103

(51) Int. Cl.[7] ..... F21V 17/02

(52) U.S. Cl. ..... 362/277; 362/319; 359/823; 359/827

(58) Field of Search ..... 362/293, 268, 362/345, 319, 321, 18, 17, 280, 277; 359/823, 827

(56) References Cited

U.S. PATENT DOCUMENTS

| | | | | | |
|---|---|---|---|---|---|
| 3,088,370 | A | * | 5/1963 | Erbe et al. | 359/823 |
| 4,232,359 | A | | 11/1980 | Leon et al. | |
| 4,686,612 | A | * | 8/1987 | Pringle et al. | 362/297 |
| 4,701,833 | A | | 10/1987 | Burnhorst | |
| 5,758,955 | A | | 6/1998 | Belliveau | |
| 6,092,914 | A | * | 7/2000 | Esakoff et al. | 362/268 |
| 6,370,336 | B1 | * | 4/2002 | Nishinou et al. | 396/277 |

FOREIGN PATENT DOCUMENTS

| | | |
|---|---|---|
| JP | 5939369 | 11/1984 |
| JP | 6289708 | 6/1987 |
| JP | 6236169 | 9/1987 |
| JP | 616362 | 3/1994 |
| JP | 722803 | 5/1995 |

* cited by examiner

*Primary Examiner*—Alan Cariaso
*Assistant Examiner*—Mark Tsidulko
(74) *Attorney, Agent, or Firm*—Dykema Gossett PLLC

(57) ABSTRACT

A lighting device includes a reflector that has forward and rearward segments separated by a clearance for cooling, a gobo holder into which gobos of differing sizes can be inserted and held in position, and a lens holder which can be moved forwardly and rearwardly in the lighting device by rotation of a gear which is attached to the lens holder and engages a rack in a slide guide in the lighting device, the gear being moved by a knob located outside the lighting device and which is rotatable with the gear and movable along the lighting device.

8 Claims, 10 Drawing Sheets

LIGHTING DEVICE

TECHNICAL FIELD

This invention relates to a lighting device such as a spotlight or the like used at a stage or a TV studio and the like, for example, in which a bulb, reflector, lens, adjustment mechanism for changing a distance between the bulb and the lens, the desired number of gobos and a holder for holding the gobos under their engaged and held state or the like are arranged at appropriate locations within a housing.

More particularly, this invention relates to an improvement of an adjustment mechanism for use in performing a focus adjustment or zoom adjustment lighting device by sliding the lens in a forward or rearward direction along the optical axis, a reflector and a holder for installing gobos (other names: a pattern, a template or the like) used for improving a stage effect in this type of lighting device.

BACKGROUND ART

As the adjustment mechanism for use in performing a focus adjustment or zoom adjustment in this type of lighting device in the prior art, it is well known to provide such a structure as one in which a lens holder for holding a lens is supported in such a way that the holder can be slid in a forward or rearward direction along the optical axis, a knob slid together with the lens holder is arranged at an outer surface of a lighting device, the knob is formed by a screw member threadably engaged with the lens holder, the lighting device is held together with the lens holder under a state in which the screw is fastened to lock its motion and in turn it can be slid under a state in which the screw is loosened.

However, the adjustment work with such a prior art adjustment mechanism as described above is carried out such that the screw is once loosened, the lens is slid together with the knob, after its position is adjusted, the screw is fastened to fix the lens position, so that there may be present a possibility that the work is troublesome and at the same time the lens position is displaced when the screw is fastened.

In addition, there is also present the adjustment mechanism utilizing a rack and pinion as shown in FIG. 13. This mechanism is constructed such that a rack 103 having a lens holder 102 fixed thereto is engaged with a pinion gear 101 turned under a rotating operation of an adjustment knob (not shown) rotated at its specified position, the rack 103 engaged with the pinion gear 101 is slid by the rotation of the adjustment knob at its specified position, resulting in the lens holder 102 being slid in a forward or rearward direction.

In accordance with such a mechanism as above, the adjustment knob is placed at its specified position, so that the lens position cannot be acknowledged from outside part of the lighting device 104 and an operator performs a position adjustment while looking at the lighting plane and it may produce a problem that a skill is needed for the fine adjustment.

When the bulb 105 has a high capacity in this type of lighting device, the thermal influence at a location of the reflector 106 which is the nearest to the filament 107 is increased and there is a possibility that the base material of the reflector 106 will become cracked or the raw material coated on the base material will peel.

In this type of lighting device described above, a gobo having various kinds of patterns opened and formed in a metallic thin plate by a punching work or an etching work is usually used for increasing a stage effect. Then, several types of gobos with different outer diameter sizes are prepared even though the gobos have the same patterns to each other, and they are separately used in response to object.

Due to this fact, several types of gobo holders corresponding to gobo sizes used for installing a gobo in the lighting device are prepared, the holder is selected in compliance with the size of gobo and applied for its use.

The gobo holder is constructed such that two metallic plates are overlapped to each other to enable the gobo formed by a metallic thin plate to be engaged and held between themselves, and the gobo is used while being inserted between the two plates of the gobo holder.

However, operations for selecting and using the gobo holder in compliance with a size of the gobo to be used are troublesome and substantially influence a workability of the gobo showing a high degree of repetition in use.

This invention has been invented in view of the aforesaid circumstances as found in the prior art and it is a first object of the present invention is to provide a lighting device having a novel lens position adjusting mechanism capable of easily performing a fine adjustment of a lens position when the lens is slid in a forward or rearward direction along the optical axis to perform a focus adjustment or a zoom adjustment and further a fixing of the lens position after adjustment can be easily performed.

It is a second object of the present invention to provide a lighting device capable of restricting influence against a reflector caused by heat generated by a bulb as much as possible.

It is a third object of the present invention to provide a lighting device having a gobo holder which can be adapted for two types of gobos of different sizes having a high degree of repetition in use (an amount of distribution) by one gobo holder.

SUMMARY OF THE INVENTION

In order to accomplish the aforesaid first object, the lighting device of the present Invention provides a lighting device in which a bulb, a reflector, lenses and an adjusting mechanism for varying a gap between the bulb and each of the lenses are arranged at appropriate locations in a lighting device, the lenses are slid in a forward or rearward direction by the adjusting mechanisms along the optical axis to perform a focus adjustment or a zoom adjustment or the like, wherein its gist consists in an arrangement in which:

the adjusting mechanism is comprised of a lens holder for holding the lenses; a slide guide segment for holding the lens holder in such a way that it may be slid in a forward or rearward direction; a rack formed along a sliding direction of the lens holder; a gear slid in a forward or rearward direction together with the lens holder while being engaged with the rack and rotated; an operating knob attached to an outer surface of the lighting device and slid in a forward or rearward direction while being integrally rotated with the gear; and a cam type lever for locking a rotation of the gear; and a cam type lever for locking a rotation of the operating knob.

With such a configuration as above, when the operating knob is turned under a state in which the cam type lever is set at the lock releasing position, the gear is rotated together with the operating knob and the gear is slid in a sliding direction of the lens holder through its engagement with the rack, thereby the lens holder is also slid integrally in a forward or rearward direction. The aforesaid motion is performed by a predetermined pitch through engagement between the gear and the rack, resulting in that the fine adjustment can be easily performed.

In addition, when the operating knob is turned in a forward direction, the lens holder slides in a forward direction, and in turn when the operating knob is turned in the opposite direction, the lens holder slides in a rearward direction, so that there is a less possibility that the knob is accidentally slid to cause the lens to be displaced in a undesired direction as found in that of the prior art sliding type.

Further, both locking against motion of the operating knob and its un-locking can be easily performed by one-finger touch operation with the cam type lever, so that the lens position adjustment work can become an easy and convenient work performed by one hand and at the same time there is a less possibility that the lens is displaced during the fixing operation after lens position adjustment.

In addition, the present invention is characterized in that the operating knob is positioned at the side part of the lens held at the lens holder in the aforesaid configuration and the lens position can be confirmed in reference to the position of the operating knob.

In accordance with such a configuration as above, the position of the operating knob is applied as a reference of the lens position, so that it is not necessary that an indicator or the like is not additionally arranged and there is a less possibility of sliding the lens in an erroneous direction The usual type of the lighting device described above has a lamp house segment storing a bulb and a reflector or the like therein and a lens barrel segment storing the lens, and at the same time the shutter mechanism having an aperture segment therein is installed between the lamp house segment and the lens barrel segment. Further, both ends of a gate-shaped yoke for use in supporting the lighting device are fixed to the lamp house segment in such a way that they may not interfere with the operating knob for the shutter blade at the shutter mechanism.

In accordance with such a construction as above, the supporting fulcrum points for the lighting device with the yoke are set at the rear part of aperture segment, i.e., at the rear position of the lighting device, resulting in that the front side of the lighting device (the side of the lens barrel segment) becomes heavy. In particular, when the focusing length is elongated, there occurs a problem that the supporting balance is deteriorated and an operability during adjustment of the tilt angle of the lighting device is poor.

In order to eliminate such problems described above, the present invention is characterized in that the lighting device in the aforesaid constitution is comprised of a lamp house segment storing a bulb and a reflector, and a lens barrel segment storing lenses, the lamp house segment is formed by metallic material and the lens barrel segment is formed by heat-resistant synthetic resin material.

In accordance with the construction described above, a mass of the lens barrel segment become light as compared with that of the prior art metallic lens barrel segments, and every if the supporting fulcrum by the yoke is set at the lamp house segment, a supporting balance of the lighting device is improved more as compared with that of the prior art and an operability at the time of adjusting a tilt angle of the lighting device is improved.

In addition to the lens barrel segment being formed by heat-resistant synthetic resin material, the aforesaid slide guide segment and rack can also be integrally formed together within the lens barrel segment.

In this case, since the lens barrel segment, the slide guide segment and the rack are integrally formed by resin material, a lightweight of the frontpart of the lighting device is promoted. Their assembling becomes easy as compared with that of the case in which the slide guide segment and the metallic rack or the like are separately manufactured and they are fixed to the lens barrel segment. Further, the modules having a fine pitch can be easily formed.

In addition, the lens barrel segment can be formed by heat-resistant synthetic resin material, both the aforesaid slide guide segment and the rack can be integrally formed with the lens barrel segment at the inner surface of the lens barrel segment, and the lens holder and the operating knob can be formed by the same quality material as that of the lens barrel segment.

In this case, the lens holder and the operating knob are resin formed products, so that a weight reduction of the front side of the lighting device is further promoted. Additionally, a troublesome manufacturing is reduced as compared with that of forming the lens holder and the operating knob with another material.

In order to accomplish the aforesaid second object, the lighting device of the present invention in which a bulb, a reflector and lenses or the like are arranged at appropriate locations in a lighting device is characterized in that the reflector is comprised of two members of a front half segment and a rear half segment, a gap is present between these members, the gap may act as an aeration hole for promoting a convection between the inner space and the outer space of the reflector and improving a thermal radiation effect.

In addition, the present invention in the aforesaid configuration is characterized in that a distance at the reflector nearest to the filament of the bulb is extended and thermal influence against the reflector with heat generated by the filament is restricted and at the same time a temperature difference between one portion at the reflector showing the highest temperature and the other portion at the reflector showing the lowest temperature is made low.

Employing such a configuration as above enables thermal influence of the bulb against the reflector to be restricted as much as possible without damaging any optical characteristic and enables phenomena such as crack at the base material of the reflector or peeling of the coating raw material to be prevented.

In order to accomplish the aforesaid third object, the lighting device of the present invention in which the bulb, the reflector and the lenses or the like are arranged at appropriate locations within the lighting device and at the same time the desired number of gobos removably held in respect of the lighting device are arranged between the bulb and the lenses under a state in which they are held by the holder in an engaged state characterized in that the gobo insertion segments are arranged in double at one holder.

That is, the two fixed base plates having window holes of the same diameter are overlapped to each other and fixed while being spaced apart by a predetermined distance with the centers of the window holes being coincided to each other to constitute the holder main body, two gobo pressing plates having the window holes of the same diameter or slightly larger diameter as or than that of the window holes opened at the fixed base plates are resiliently arranged against the opposing fixed base plates with the centers of the window holes being coincided to each other inside both fixed base plates and the two gobo insertion segments are arranged.

It is effective that metallic plates (steel plates) having a less thermal deformation are applied as the two fixed base plates constituting the aforesaid holder main body and a black heat-resistant enamel coating is applied to eliminate a light reflection at the surfaces of the plates.

In addition, as means for engaging and assembling the two fixed base plates, rivet fixings, for example, are applied.

Further, as a biasing means for press contacting the two gobo pressing plates arranged inside the two fixed base plates against each of the opposing fixed base plates, either a coil spring or a leaf spring or the like is used, they are resiliently installed between the two gobo pressing plates and an outward pressing force may act against both gobo pressing plates.

In accordance with the aforesaid configuration, each of the inside portions of two fixed base plates constituting the holder main body is combined with the gobo pressing plate to constitute a double formation of the gobo insertion segments. Accordingly, any one of the gobo insertion segments is selected in compliance with a size of gobo to be used, the gobo pressing plate is spaced apart from the fixed base plate against a resilient force, and the gobo is inserted between the fixed base plate and the gobo pressing plate to enable the gobo to beset. Then, the gobo insertion segment having the gobo inserted therein is directed toward the bulb of the lighting device to enable any of the gobo insertion segments to be fixed against the lighting device under the same state when any of the gobo insertion segments is used.

Further, the centering protuberances for setting a position of the gobo are arranged around the window hole at the inside surfaces of the front and rear fixed base plates constituting the aforesaid holder main body to enable the gobo insertion and setting to be easily carried out. The two centering protuberances are arranged at symmetrical positions on the concentric circle with the center of the window hole being applied as a center for it.

In accordance with such a configuration as above, since the centering protuberances for use in setting a position of the gobo are arranged at the fixed base plate constituting each of the insertion segments, it is possible to perform an easy positional alignment in which the center of the gobo is coincided with the center of the window hole opened at the fixed base plate of the holder main body.

Further, it is also applicable that the front and rear fixed base plates at the aforesaid holder main body may be formed with the finger pushing openings for pressing the aforesaid gobo pressing plate in an opposing direction apart from the fixed base plate opposing against a resilient force of a spring. The openings are arranged above and below the window hole and their shapes are optional shapes such as a rectangular shape, a circular shape or a notch and the like.

In the case that they are constituted as above, since the fixed base plates constituting the holder main body are formed with the finger pushing openings for pressing the gobo pressing plate opposing against each of the fixed base plates in a direction apart from each of the fixed base plate, the gobo pressing plates can be conveniently slid away from the fixed base plates for inserting the gobo. Then, in the case that the openings are arranged above and below the window hole, the opening operation for the gobo pressing plates can be easily carried out with the other side being applied as a fulcrum point.

BRIEF DESCRIPTION OF THE DRAWINGS

FIG. 7 (ii) is an enlarged sectional view taken along line (C)—(C) in FIG. 6.

BEST MODE FOR CARRYING OUT EMBODYING THE INVENTION

Figure 1:
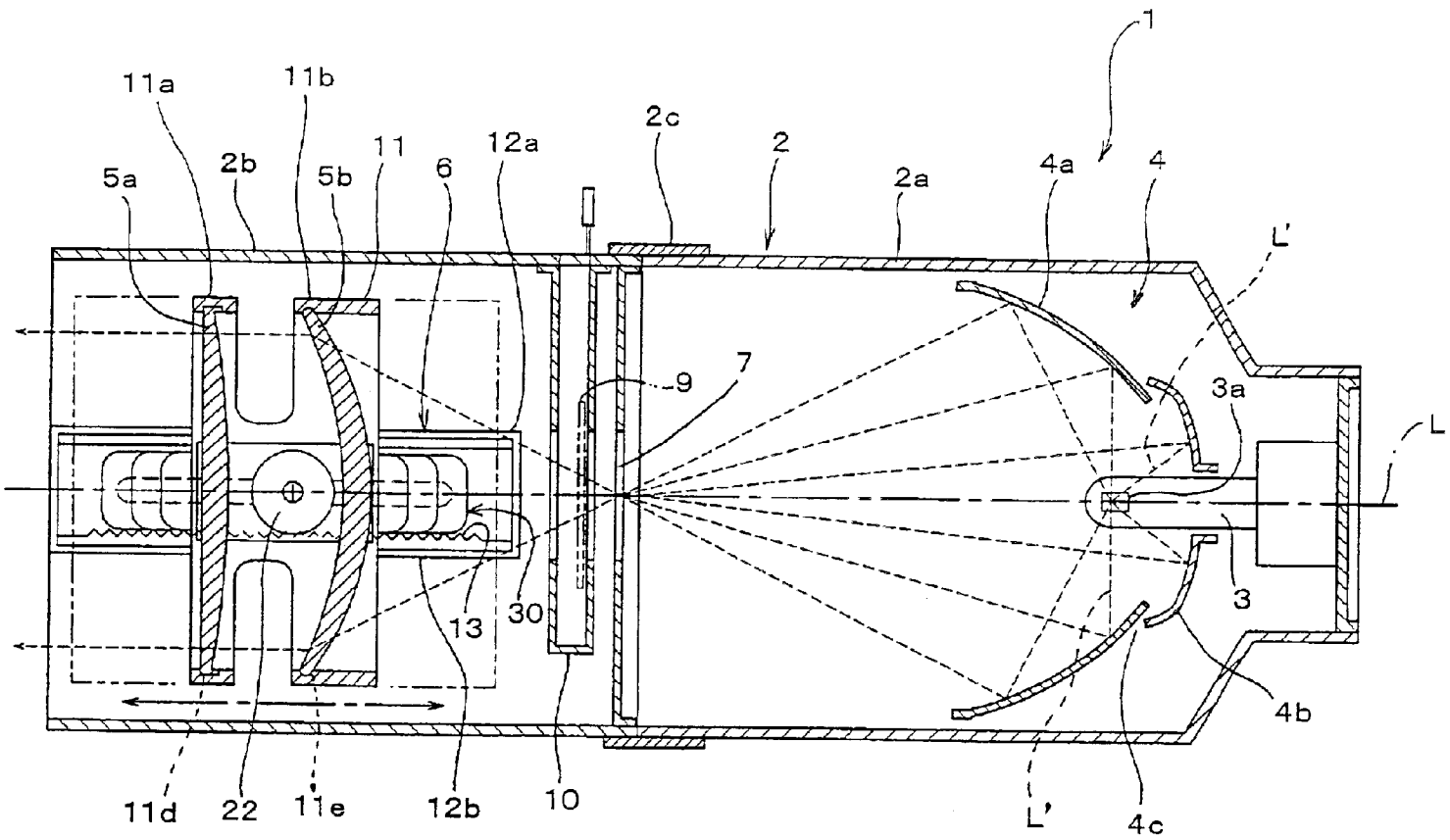
FIG. 1 is a simplified sectional view for showing one example of a preferred embodiment of a lighting device of the present invention.
Figure 2:
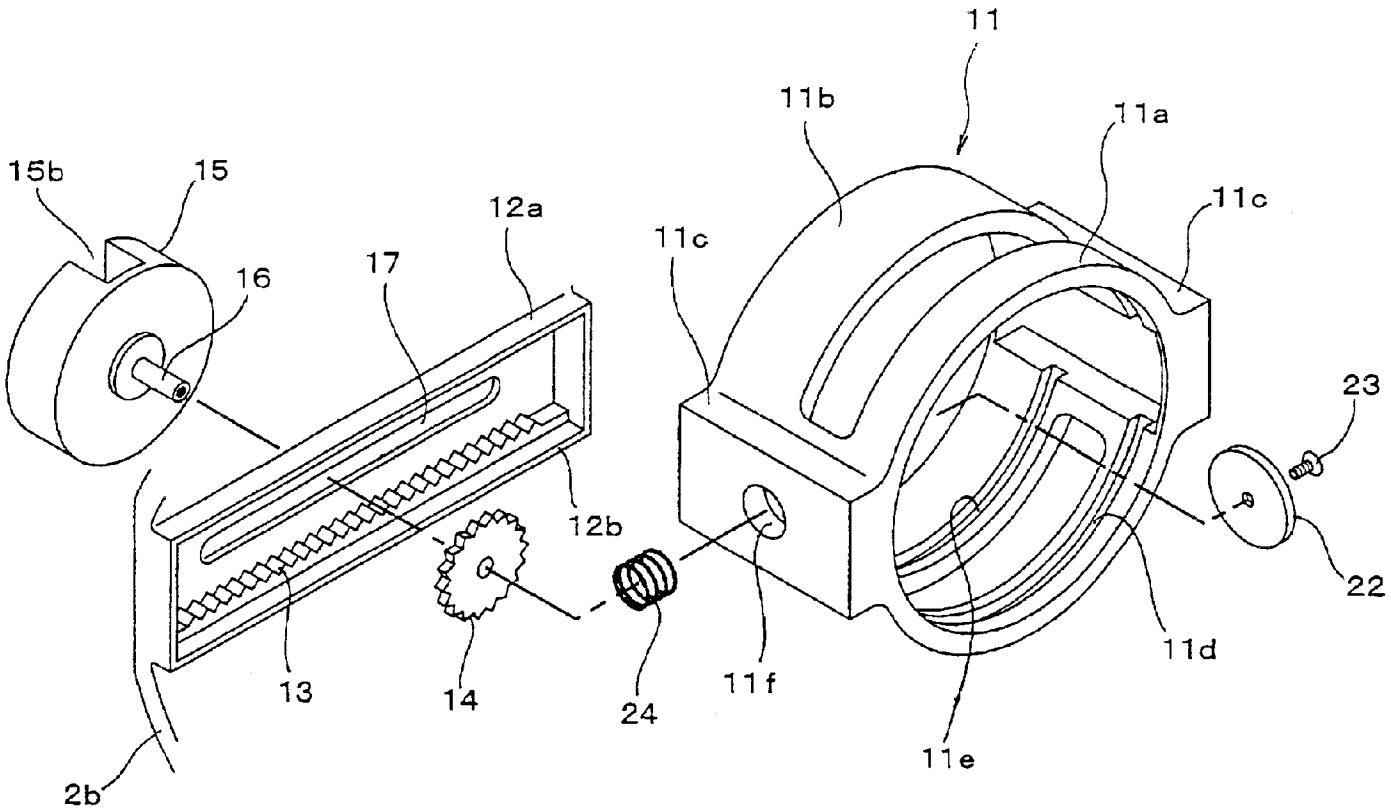
FIG. 2 Is an exploded perspective view showing an adjustment mechanism in an enlarged form.
Figure 3:
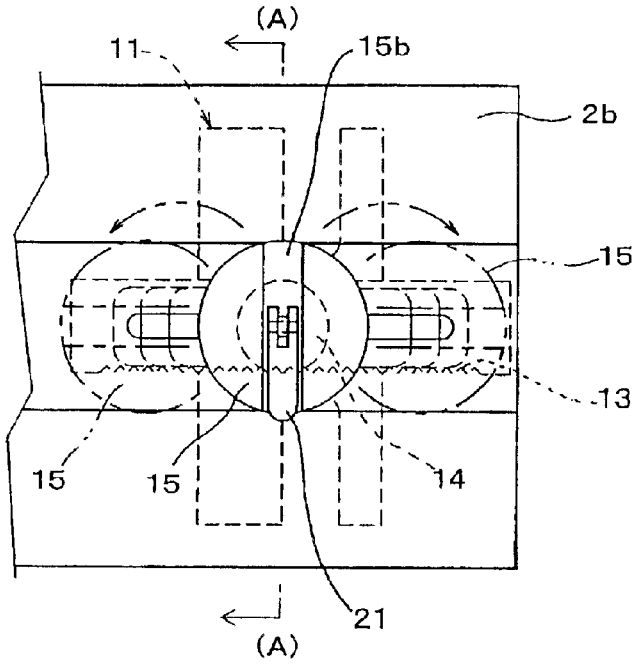
FIG. 3 is a side elevational view showing an operating knob part in its enlarged form.

Referring to the drawings, one example of the preferred embodiment of the present invention will be described as follows.

FIG. 1 is a simplified sectional view for showing a schematic configuration of the lighting device 1 of the present invention. In this figure, reference numeral 2 denotes a lighting device, reference numeral 3 denotes a bulb, reference numeral 4 denotes a reflector, reference numerals 5*a*, 5*b* denote a lens, respectively, reference numeral 6 denotes a lens position adjustment mechanism for changing a distance between the bulb 3 and the lenses 5*a*, 5*b*, reference numeral 7 denotes an aperture, reference numeral 10 denotes a gobo holder slot for use in setting a gobo 9 held by a gobo holder 8 while being held in such a way that it may be freely inserted into or pulled out of it, and L denotes the optical axis.

The lighting device 2 has a structure in which there is provided a shutter frame 2*c* storing a shutter blade (not shown) for use in shielding light passing through the aperture 7 into an optional shape between a lamp house segment 2*a* storing both the bulb 3 and the reflector 4, and a lens barrel segment 2*b* storing lenses 5*a*, 5*b*, wherein the lamp house segment 2*a* and the shutter frame 2*c* are formed by metallic material such as aluminum or the like and the lens barrel segment 2*b* is formed by heat-resistant synthetic resin.

The lens position adjustment mechanism 6 of the present invention is a focus adjustment mechanism for changing a distance between a pair of lenses 5*a*, 5*b* and the aperture 7 so as to adjust a focusing point, and this lens position adjustment mechanism is comprised of a lens holder 11 for holding the lenses 5*a*, 5*b*; guide rails 12*a*, 12*b* for holding the lens holder 11 in such a way that the lens holder 11 can be freely slid forward or rearward; a rack 13 formed along a sliding direction of the lens holder 11; a gear 14 engaged with the rack 13; an operating knob 15 arranged at the outer surface of the lighting device 2 and slid forward or rearward while being integrally rotated with the gear 14; and a lock mechanism 20 for locking a rotation of the operating knob 15 by a cam type lever 21.

The lens holder 11 is integrally formed with heat-resistant synthetic resin material having the same quality as that of the lens barrel segment 2*b*, it has cylindrical frames 11*a*, 11*b* holding the lenses at the front side and the rear side of the inner circumferential part of it, fitting protuberances 11*c*, 11*c* fitted in such a way that they may be freely slid in forward or rearward directions are cooperatively arranged and formed between the upper and lower guide rails 12*a*, 12*b* over the right and left outer circumferential edges of these both frames 11*a*, 11*b*, and at the same time the inner circumferences of the cylindrical frames 11*a*, 11*b* are formed with grooves 11*d*, 11*e* for use in fitting and holding the lenses 5*a*, 5*b*.

The guide rails 12*a*, 12*b* are slide guide segments for holding the lens holder 11 within the lens barrel segment 2*b* in such a way that the lens holder can be freely slid in a forward or rearward direction along the optical axis L, wherein the guide rails are integrally formed with the lens barrel segment 2*b* at the right and left positions in the inner circumferential surface of the lens barrel segment 2*b*.

A rack 13 is integrally formed with the lens barrel segment 2*b* along the upper side of a lower guide rail 12*b* in any one of right and left guide rails.

A longitudinal hole-shaped guide hole 17 for use in guiding a motion of the shaft 16 in a forward or rearward direction to be described later is formed at the side surface of the lens barrel segment 2*b* having the rack 13 formed therein is formed between the upper and lower guide rails 12*a*, 12*b*.

The gear 14 is engaged with the rack 13 and slides forward or rearward in a sliding direction of the lens holder 11 while being rotated, wherein the gear 14 is unrotatably inserted into and fitted to the shaft 16 projecting to the rear surface of the operating knob 15 and is formed to be rotated in integral with the operating knob 15.

The operating knob 15 is integrally formed with the lens barrel segment 2*b* by the same heat-resistant synthetic resin material as that of the lens barrel segment 2*b*, wherein the operating knob 15 is formed into a disk shape having a predetermined thickness to enable its rotating operation to be easily carried out, its central part is provided with a through-hole 15*a* into which the shaft 16 is slidably inserted and a recess 15*b* having a cam type lever 21 stored therein is formed at its position extending along a diameter in its front elevational side.

The shaft 16 is slidably inserted into the through-hole 15*a*, its outer end projects into the recess 15*b* and its inner end passes through the guide hole 17 and projects into a large diameter hole 11*f* arranged at the central part of the fitted protuberance 11*c*. In this way, the base end of the cam type lever 21 is rotatably installed at the outer end of the shaft 16 and an engaging plate 22 contacted with the inner surface of the fitted protuberance 11*c* is fixed to its inner end with a screw 23. The gear 14 is fixedly inserted and fixed as described above at the shaft 16 between the fitted protuberance 11*c* and the guide hole 17, and a spring 24 for biasing the engaging plate 22 in a direction sliding away from the fitted protuberance 11*c* is installed between the engaging plate 22 and the gear 14.

Figure 4:
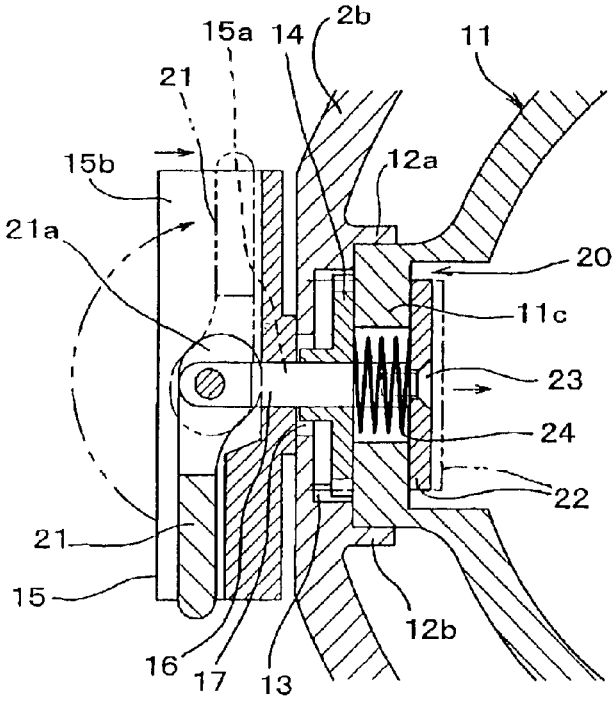
FIG. 4 is an enlarged sectional view taken along line (A)—(A) of FIG. 3.
Figure 5:
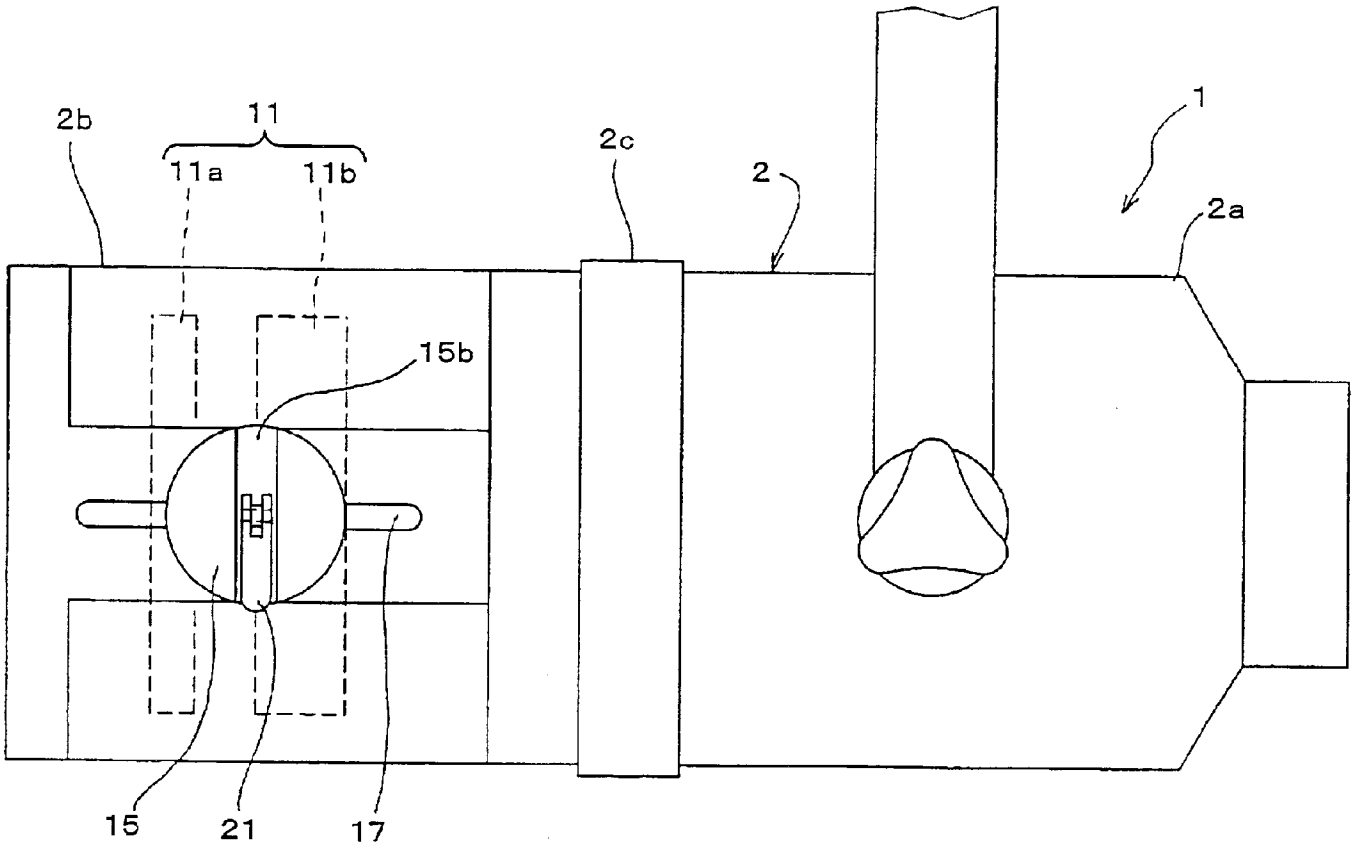
FIG. 5 is an outer appearance side elevational view showing a lighting device in accordance with the present invention.

The cam type lever 21 has integrally a cam part 21*a* at its base end, and is formed to be rotatable between a lock position (a position indicated by a solid line 21 in FIG. 4) where the central part of the cam part 21*a* of its eccentric rotation is rotatably set at the outer end of the shaft 16, the shaft 16 is pulled toward the outer end under a cam action of the cam part 21*a*, the engaging plate 22 is press contacted with the fitting protuberance 11*c* against a biasing force of the spring 24, the lens barrel segment 2*b* is held with the fitting protuberance 11*c* and the operating knob 15 to cause motion of the operating knob 15 and the lens holder 11 to be locked, and a locked releasing position (a position indicated by an imaginary line 21 in FIG. 4) where the cam action of the cam part 21*a* does not act, the engaging plate 22 is slid away from the engaging protuberance 11*c* with the biasing force of the spring 24 to cause the operating knob 15 and the lens holder 11 to be freely slidable.

A shielding mechanism denoted by reference numeral 30 in the figure is used for preventing light from being leaked out of the guide hole 17 described above and this mechanism is a well-known structure in which a plurality of light shielding plates are overlapped from each other.

In the case that a focus adjustment is carried out with the adjustment mechanism 6 of the present invention having the aforesaid configuration, at first, the cam type lever 21 is turned up to the lock releasing position, then the operating knob is rotated in its forward direction or opposite direction, resulting in that the gear 14 is integrally rotated with the operating knob. The gear 14 is slid in a forward direction or a rearward direction of the lighting device along the sliding direction of the lens holder by a predetermined pitch through its engagement with the rack 13, and the operating knob 15 and the lens holder 11 are slid in a forward direction or a rearward direction in an integral manner to perform a positional adjustment of each of the lenses 5*a*, 5*b*. In this case, since the lens holder 11 is slid by a predetermined pitch through an engagement between the gear 14 and the rack 13, a fine adjustment for position of each of the lenses 5*a*, 5*b* can be easily carried out.

Upon adjustment of position, the cam type lever 21 is rotated up to the lock position and the position of each of the lenses 5*a*, 5*b* is fixed.

The operating knob 15 is positioned at the side between the lenses 5*a*, 5*b* and the operating knob 15 is applied as a scale for setting positions of the lenses 5*a*, 5*b*, so that it can be judged at once whether or not the lenses 5*a*, 5*b* are slid in a forward direction or in a rearward direction, resulting in that the adjustment work can be easily carried out.

In addition, the lens barrel segment 2*b*, the lens holder 11, the operating knob 15, the guide rails 12*a*, 12*b* and the rack 13 or the like are formed by synthetic resin, so that the front side of the lighting device 2 becomes light as compared with that of the case in which these members are made of metal. Thus, even if a supporting fulcrum point of the lighting device 2 is set at the lamp house segment 2*a*, a well-balanced state in supporting the lighting device 2 can be assured and in particular an operability is improved when a tilt angle is adjusted.

As described above, the lens barrel segment 2*b* or the like in the present invention are made of heat-resistant synthetic resin and the lamp house segment 2*a* is made of metallic material such as aluminum. However, it may also be applicable that the lens barrel segment 2*b* is formed by light alloy material such as magnesium alloy and titanium alloy or the like in reference to setting a weight reduction formation of the lens barrel segment 2*b*.

In addition, although the focus adjustment at the lighting device using two lenses has been illustrated, it is apparent that the present invention is not restricted to this embodiment and either the number of the lenses or their type can be properly selected in response to an effect of lighting to be attained and further it can be adapted for a zoom adjustment as well.

The bulb 3 is a halogen bulb emitting light through supplying an electrical power from a power supply cord (not shown) and a single halogen bulb is shown in the example of preferred embodiment, although a plurality of bulbs can be applied.

The reflector 4 shows a curved surface, and this reflector is formed by thermal beam transmittance material for reflecting entire visible light beams of light emitted by the bulb 3 and permeating infrared ray through itself.

Accordingly, since the reflector 4 has a less amount of thermal radiation in a forward direction, it can prevent thermal deformation of a member within the lighting device 2 and at the same time it can reduce a reduction in lifetime of the bulb 3 caused by an increased temperature around the bulb 3.

As shown in FIG. 1, the reflector 4 of the present invention is comprised of two members of a forward half segment 4*a* and a rearward half segment 4*b*, the reflector is constructed such that a clearance 4*c* is provided between these both members 4*a*, 4*b*, wherein the clearance 4*c* acts as an aeration hole for promoting a convection flow between an inside part and an outside part of the reflector 4, improving an effect of thermal radiation, releasing heat of the bulb 3 generated inside the reflector 4, reducing a thermal influence when the bulb of high capacity is used and preventing some phenomena in which the base material of the reflector 4 is cracked or the raw material coated on the base material is peeled off and the like.

Further, the separated structure of the reflector 4 described above causes a distance L' of the portion nearest to the filament 3*a* of the bulb 3 at the reflector 4 to be elongated, a thermal influence set by generated heat at the filament 3*a* to be restricted as much as possible, a temperature difference between one portion showing the highest temperature and the other portion showing the lowest temperature at the reflector 4 to be reduced, influence by the temperature difference to be restricted, and some phenomena such as a crack of the base material described above as well as the peeling of raw material and the like to be prevented.

Figure 6:
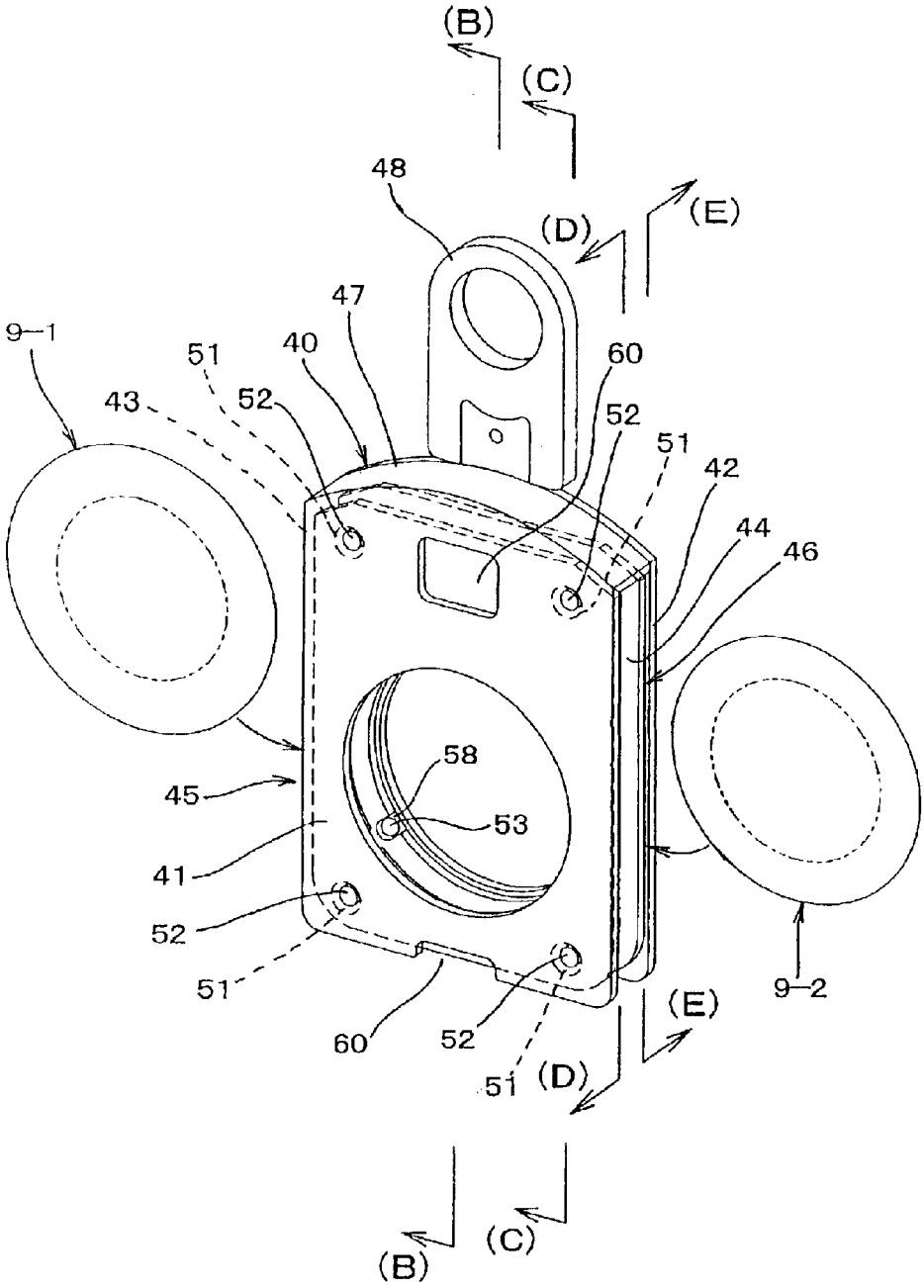
FIG. 6 is a perspective view for showing one example of a holder for a gobo used in a lighting device in accordance with the present invention.
Figure 7:
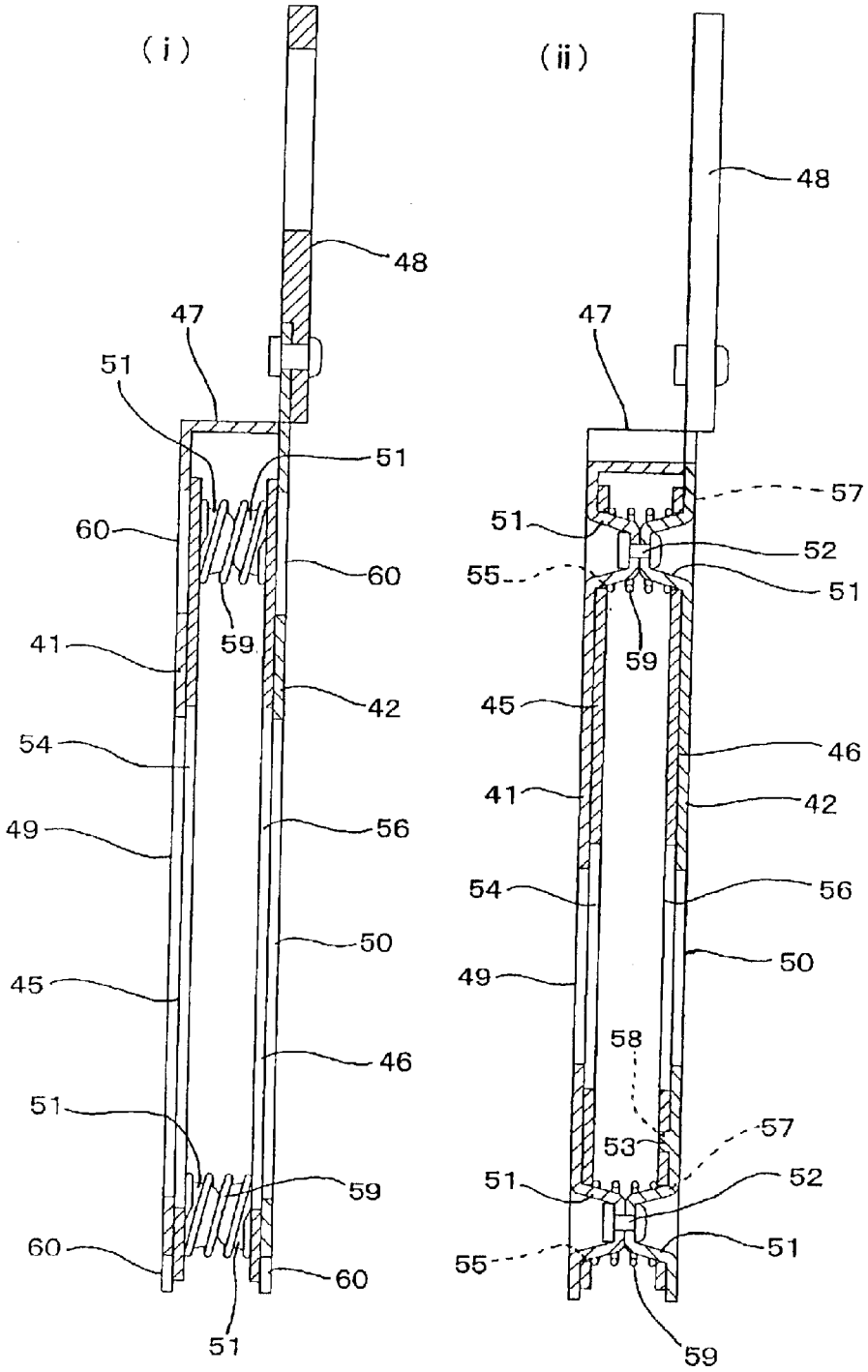
FIG. 7 (i) is an enlarged sectional view taken along line (B)—(B) in FIG. 6.
Figure 8:
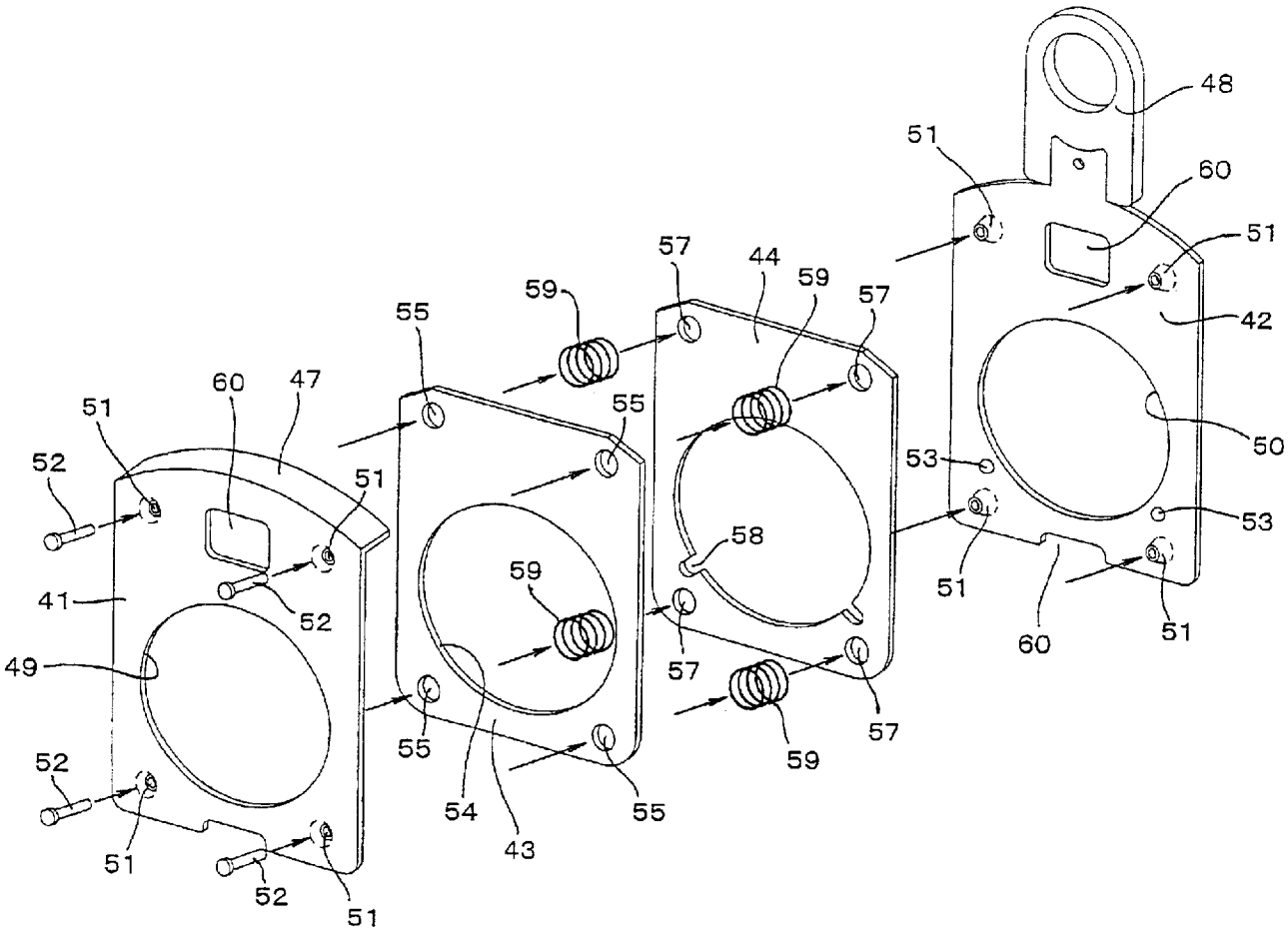
FIG. 8 is an exploded perspective view.
Figure 9:
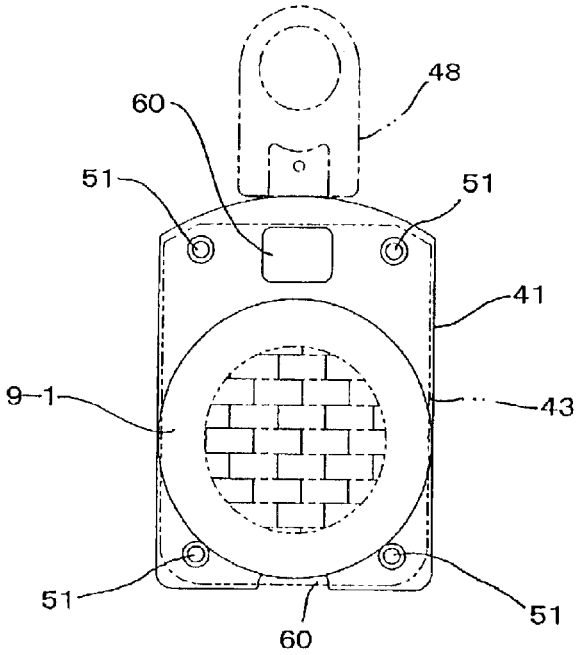
FIG. 9 is a rear view taken along line (D)—(D) in FIG. 6.
Figure 10:
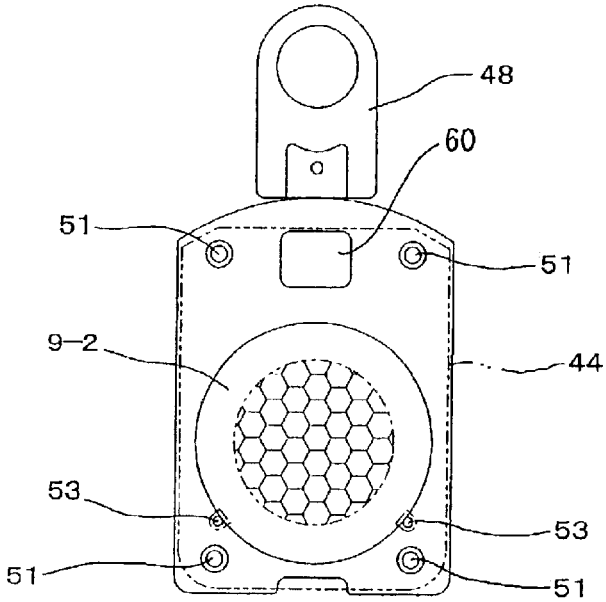
FIG. 10 is a front elevational view taken along line (E)—(E) in FIG. 6.

FIG. 6 illustrates the aforesaid gobo 9 and its holder 8. The holder 8 is comprised of a holder main body 40 constituted by two fixed base plates 41, 42 arranged inside the holder main body 40 in such a way that they can be slid to or away from the fixed base plates 41, 42, and of two gobo pressing plates 43, 44, and two gobo insertion segments 45, 46 are formed.

The two fixed plates 41, 42 constituting the holder main body 40 are formed into a rectangular shape with a steel plate of which thermal deformation is less, and one fixed base plate 41 is cooperatively formed with a spacer 47 for holding its adhering with the other fixed base plate 42 in a predetermined spacing at its one side (the upper side as seen in the figure) in a substantial right angle. A knob 48 is integrally protruded and formed at the upper side of the fixed base plate 42.

In addition, circular window holes 49, 50 having the same size to each other for determining a light projecting range are opened at the fixed base plates 41, 42, and further hubs 51 with a substantial trapezoidal sectional shape are protruded and formed at four corners in the inner surfaces of both base plates 41, 42, the hubs 51 of both fixed base plates 41, 42 are abutted to them, the abutted hubs are fastened to each other with rivets 52 to assemble the holder main body 40.

The two hubs in the aforesaid hubs 51 formed near the lower side of the fixed base plate 41, i.e. formed at a lower position than the lower hole edge of the window hole 49 have a position setting function in which the gobo 9-1 inserted into the gobo insertion segment 45 constituted by the fixed base plate 41 and the gobo pressing plate 43 arranged in opposition to the fixed base plate 41 with its center being coincided with the window hole 49. Due to this fact, the two hubs 51 arranged at lower positions are arranged and formed on a concentric circle with the center of the window hole 49 being applied as a center and at the right and left symmetrical positions in respect to a vertical line passing through the center. With such an arrangement above, the gobo 9-1 is inserted into the gobo insertion segment 45 and the circumferential edge of the gobo 9-1 is abutted against the outer circumferential surfaces of the aforesaid two hubs 51 to enable the gobo 9-1 to be set at a specified position in respect to the window hole 49.

In addition, the inner surface of the fixed base plate 42, i.e. the surface opposing against the gobo pressing plate 44 arranged in the holder main body 40 is formed with position setting centering protuberances 53 to cause the center of the inserted gobo 9-2 to be coincided with the center of the aforesaid window hole 50.

The centering protuberances 53 are arranged on a concentric circle with the center of the window hole 50 being applied as a center, and formed on the right and left symmetrical positions in respect to a vertical line passing through the center in the same manner as that of the hubs 51 also acting as the centering protuberances for position setting the gobo 9-1 inserted into the aforesaid gobo insertion segment 45. In the preferred embodiment of the present invention, since the size relation between the gobos 9-1 and 9-2 has 9-1>9-2, the aforesaid centering protuberance 53 is arranged and formed between the hub 51 and the window hole 50.

With such an arrangement as above, the gobo 9-2 is inserted into the gobo insertion segment 46 and the circumferential edge of the gobo 9-2 is abutted against the outer circumferential surfaces of the aforesaid two centering protuberances 53 to enable the gobo 9-2 to be set at a specified position in respect to the window hole 50.

The gobo pressing plate 43 arranged inside the fixed base plate 41 is formed substantially in the same shape as that of the fixed base plate 41 under application of a steel plate in the same manner as that of the fixed base plate 41, a window hole 54 slightly larger than the window hole 49 opened at the fixed base plate 41 is opened in the base plate. A through-hole 55 having the hub 51 fitted therein is opened at a position where it may correspond to the hub 51 of the fixed base plate 41 when the center of the window hole 54 is coincided with the center of the window hole 49 of the fixed base plate 41. With such an arrangement as above, the gobo pressing plate 43 is supported in such a way that it may be slid to or away from the fixed base plate 41 with the hub 51 being applied as a guide.

The gobo pressing plate 44 arranged inside the fixed base plate 42 is provided with the window hole 56 and a through-hole 57 having the hub 51 fitted therein in the same manner as that of the aforesaid gobo pressing plate 43, and further the gobo pressing plate 44 is recessed at 58 at a position corresponding to the centering protuberance 53 formed at the fixed base plate 42. With such an arrangement as above, the gobo pressing plate 44 is abutted against the inside surface of the fixed base plate 42 and at the same time the gobo pressing plate 44 is supported in such a way that it may be slid to or away from the fixed base plate 42 with the hub 51 being applied as a guide. The recess 58 for use in releasing the centering protuberance 53 may be of such a hole as one capable of storing the centering protuberance 53.

Then, a compression coil spring 59 is fitted to the hubs 51 of the fixed base plates 41, 42, and resiliently press installed between the aforesaid gobo pressing plates 43, 44. Accordingly, each of the gobo pressing plates 43, 44 is biased outwardly with a resilient force of the compression coil spring 59 and pushed against the fixed base plates 41, 42 of the holder main body 40.

In addition, each of the fixed base plates 41, 42 constituting the aforesaid holder main body 40 is formed with finger pushing openings 60, at the upper and lower positions where the window holes 49, 50 are held, for use in pushing the fingers pressing gobo pressing plates 43, 44 biased in such a direction as one to cause themselves to be close contacted with the fixed base plates 41, 42 by a resilient force of the aforesaid compression coil spring 59. In addition, in the case of the example shown in the drawings, the lower finger pushing openings 60 are made such that the lower edges of the fixed base plates 41, 42 are recessed to expose the gobo pressing plates 43, 44, the lower finger pushing openings may also be formed into holes in the same manner as that of the upper finger pushing openings. Additionally, the positions where the finger pushing openings 60 are arranged are not limited to the illustrated positions, but they may be formed, for example, by recessing the right and left edges of the fixed base plates 41, 42.

Then, referring to FIGS. 11 and 12, an operation for inserting and setting the gobos 9-1, 9-2 having different sizes (outer diameters) to the aforesaid gobo holder 8 will be described.

Figure 11:
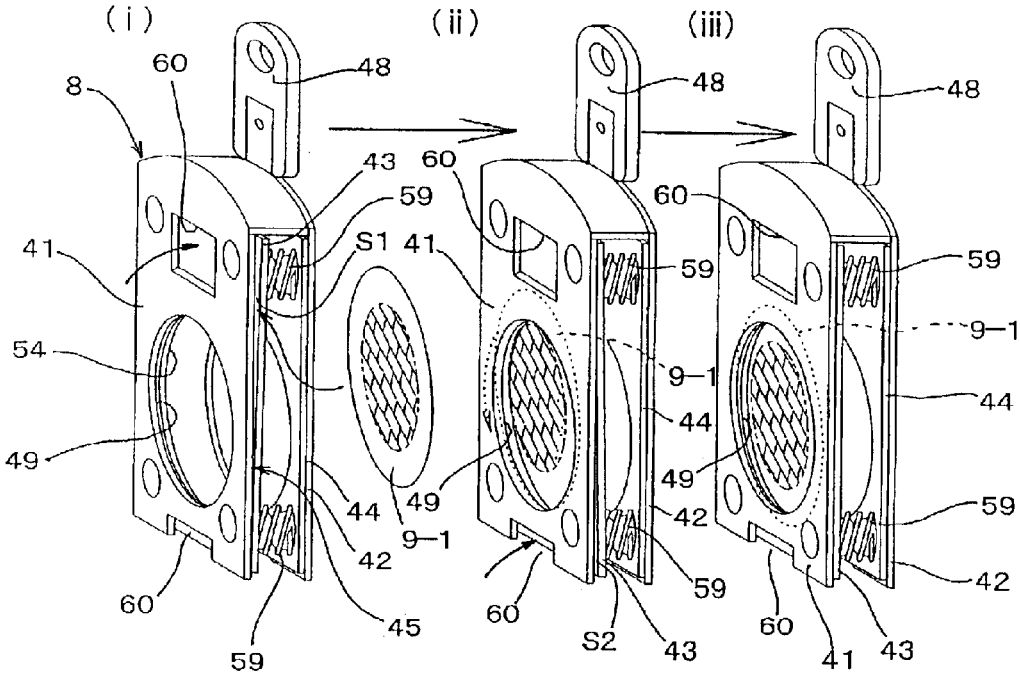
FIG. 11 is a processing step view for showing an operation for setting a gobo of large diameter to the gobo insertion segment of a holder.

FIG. 11 shows an operation for inserting and setting the large diameter gobo 9-1 to the gobo inserting segment 45.

In FIG. 11(i), the gobo pressing plate 43 at its upper side is slid in a repelling direction by a resilient force of the compression coil spring 59 with its lower side press contacted to the fixed base plate 41 being applied as a fulcrum point under a state in which the thumb of an operator is put into the finger pushing opening 60 formed at the upper side of the fixed base plate 41 constituting the gobo insertion segment 45 to depress down the gobo pressing plate 43, and a clearance S1 is formed between it and the inner surface of the fixed base plate 41. Accordingly, the gobo 9-1 is inserted into the clearance S1 from the side part of the holder while the gobo pressing plate 43 is kept being pressed through the finger pushing opening 60.

FIG. 11(ii) shows a state in which the lower side of the gobo pressing plate 43 is pressed down through the finger pushing opening 60 formed at the lower side of the fixed base plate 41, wherein the gobo pressing plate 43 is slid in the repelling direction with its upper side being applied as a fulcrum point in opposition to the above description and a clearance S2 is formed between it and the lower side of the fixed base plate 41. With this arrangement above, the gobo 9-1 inserted into the clearance S1 is slid toward the center of the window hole 49 and then the outer circumferential edge of the gobo 9-1 is abutted against the outer circumferential surfaces of the lower hubs 51 acting as the centering protuberances.

FIG. 11(iii) shows a case in which the center of the gobo 9-1 is coincided with the center of the window hole 49 under the aforesaid operation, the gobo 9-1 is engaged and held at the predetermined position by the fixed base plate 41 and the gobo pressing plate 43 under a state in which the depressing force is released through the finger pushing opening 60, resulting in that its setting is completed.

Figure 12:
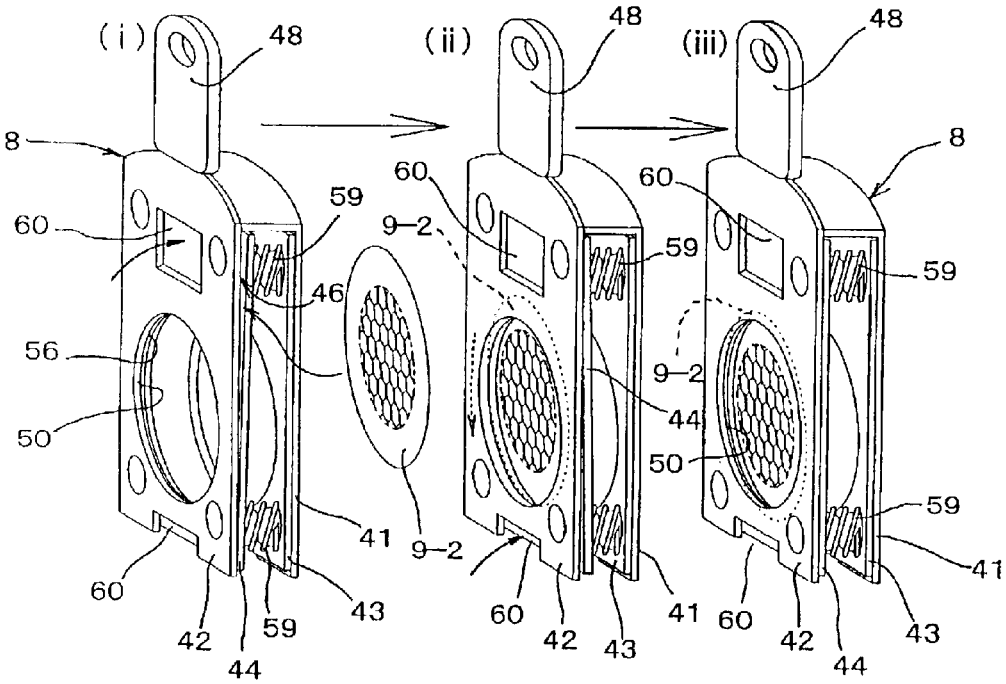
FIG. 12 is a processing step view for showing in operation for setting a gobo of small diameter to the gobo insertion segment of a holder.
Figure 13:
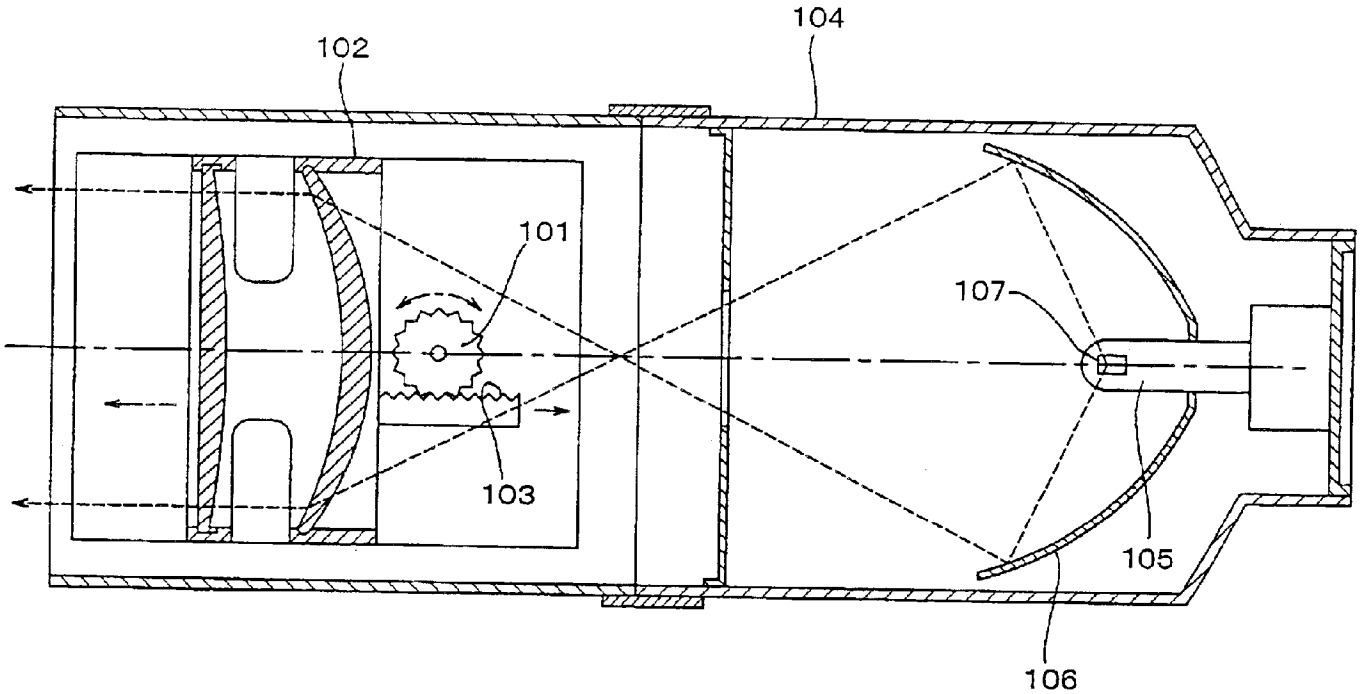
FIG. 13 is a simplified sectional view for showing one example of a focus adjustment mechanism of a prior art lighting device.

FIG. 12 shows an operation for inserting and setting a small-diameter gobo 9-2 into the gobo insertion segment 46 and the gobo 9-2 can be inserted into the holder 8 and set there by the same operation as that described in reference to FIGS. 11(i) to (iii). In FIG. 12(ii), the position setting of the gobo 9-2 inserted into a clearance between the fixed base plate 42 and the gobo pressing plate 44 is carried out by the centering protuberances 53 formed at the fixed base plate 42.

In addition, the insertion of the gobos 9-1, 9-2 is not limited to the method for separately operating and inserting their upper side and lower side as described above, but it may also be applicable that their upper side and lower side are operated concurrently, the entire gobo pressing plate 43 or 44 is repelled at once, thereby the gobos 9-1, 9-2 are inserted into the clearance formed by the repelled gobo pressing plate.

Then, the holder 8 having the gobo 9-1 or 9-2 set therein is inserted into and set at the holder slot 10 in the lighting device 2 of the lighting device 1 as shown in FIG. 1. However, the holder 8 is set such that the two gobo insertion segments are arranged in a certain clearance (about 7 mm or so, for example), the holder 8 has a certain thickness and the holder 8 can be inserted into the holder slot 10 in any orientation (the surface having the gobo inserted therein is oppositely faced against the bulb 3 or oppositely faced against the lens 5*b*). Due to this fact, an image formation of the projecting gobos 9-1, 9-2 can be made sharp or burr in its image by changing an inserting direction of the holder 8 having the gobos 9-1, 9-2 inserted and set therein in respect to the holder slot 10.

INDUSTRIAL APPLICABILITY

Since the lighting device in accordance with the present invention has been constructed as described above, the lighting device has the following effects.

(Claim 1)

The lenses are slid in a forward or rearward direction by a predetermined pitch through an engagement between the gear and the rack, so that a fine adjustment for the lenses can be attained more easily as compared with that of the prior art slide type adjustment mechanism, no accidental motion of the knob occurs as found in the prior art slide type adjustment mechanism. Applying the cam type lever enables the fixing or motion of lenses to be carried out through one-hand operation and the motion of the lens is performed through one-hand operation in which the operating knob is merely carried out by its rotating operation, so that adjustment for the lens position can be carried out easily and accurately without requiring any skill in the art.

(Claim 2)

This claim provides some effects that a position of the operating knob becomes a scale of a lens position, a lens position can be acknowledged without requiring any additional indicator or the like and a possibility of erroneous setting of a lens sliding direction becomes less.

(Claim 3)

This claim provides some effects that a mass of the lens barrel segment becomes low as compared with that of a metallic lens barrel segment and even if a supporting fulcrum point with the yoke is set at the lamp house segment, a supporting balance for the lighting device is improved more as compared with that of the prior art system, and an operability for adjusting a tilt angle of light projection (a tilt angle) is improved.

(Claim 4)

A convection flow is generated to communicate between an inner space and an outer space of the reflector due to a clearance arranged between a forward half segment and a rearward half segment of the reflector, an effect of thermal radiation around the reflector is improved, and some phenomena such as a crack of base material of the reflector and peeling of coating raw material under a thermal influence of the bulb can be prevented without damaging any optical characteristic.

(Claim 5)

A distance at the portion approaching most at a filament of the reflector is elongated to enable a thermal influence against the reflector caused by heat generated at the filament to be restricted as much as possible and the aforesaid effect can be more effectively attained.

(Claim 6)

Two types of gobos of different sizes can be fixed to one holder. Accordingly, a holder is selected in compliance with a gobo to be used and its individual application is not required, so that a smooth preparation for the work can be performed. Then, the gobo inserted and set is press attached and held with the gobo pressing plate pushed against the fixed base plate, so that it is possible to prevent the gobo from being displaced.

(Claim 7)

A position setting of the gobo can be easily carried out.

(Claim 8)

An operation for sliding the gobo pressing plate away from the opposing fixed base plate can be performed in a simple and easy manner.

What is claimed is:

1. A lighting device in which a bulb, a reflector and lenses are arranged at appropriate locations in a lighting device, and a desired number of gobos held to be insertable or removal against the lighting device under a state in which they are engaged and held by a holder are arranged between the bulb and the lenses, wherein said gobos are made such that a pattern is opened and formed in a disk made of thin metallic plate;

said holder constitutes a holder main body in which two fixed base plates having window holes of same diameter opened therein are overlapped and fixed to each other while keeping a predetermined space with the centers or the window holes being coincided to each other;

two gobo pressing plates having the window holes of same diameter or slightly larger diameter as that of or than that of the window holes opened at the fixed base plate are arranged inside both fixed base plates in such a way that they may be resiliently contacted with or separated from the opposing fixed base plates with the centers of said window holes being coincided to each other; and there are provided two gobo insertion segments.

2. A lighting device according to claim 1, wherein the inner surfaces of the front and rear fixed base plates in said holder main body are provided with the centering protuberances for setting positions of the gobos around the window hole.

3. A lighting device according to claim 1, wherein the front and rear fixed base plates in said holder main body are formed with finger pushing openings for pushing said gobo pressing plates apart from the opposed fixed base plates against resilient force of a spring.

4. A lighting device comprising a housing containing a bulb, a reflector and a lens, and including an adjusting mechanism for varying the distance between the lens and the bulb along an optical axis of the housing for focus or zoom adjustment, said adjusting mechanism comprising:

a lens holder located in the housing for mounting the lens, a slide guide segment located within said housing, a rack located in said slide guide segment, a gear attached to the lens holder and engaged with the rack to cause said lens holder and said gear to move relative to the slide guide segment and along said optical axis with rotation of the gear, a rotatable operating knob located outside said housing and attached to said gear to cause said gear to rotate with rotation of said operating knob, and a cam lever for engaging said operating knob to prevent rotation thereof.

5. A lighting device according to claim 4, wherein said slide guide segment is fixedly attached to said housing.

6. A lighting device which comprises:

a lamp housing containing a lamp and a reflector for projecting light forwardly of the lamp housing, a lens barrel forwardly of the lamp housing and defining a longitudinal slot, a lens holder located in the lens barrel and containing first and second lenses mounted therein at a fixed spacing therebetween, and an adjustment mechanism for moving said lens holder within said lens barrel towards and away from said lamp housing, said adjustment mechanism comprising a rack fixedly positioned within said lens barrel, an operating knob located outside said lens barrel, a shaft extending from said operating knob through said longitudinal slot and engaged with said lens holder, and a gear connected to said shaft and engaged with said rack so that rotation of said operating knob will cause said gear to rotate and move forwardly or rearwardly along said rack and thus move said lens holder toward or away from said lamp housing, said operating knob including a cam locking lever.

7. A lighting device according to claim 6, wherein said shaft moves along said longitudinal slot and said operating knob moves along said lens barrel as said operating knob is rotated.

8. A lighting device according to claim 6, wherein said lamp housing is made of metal and said lens barrel is made of a heat-resistant plastic.

* * * * *